US007145466B2

(12) United States Patent
Haynes et al.

(10) Patent No.: US 7,145,466 B2
(45) **Date of Patent: *Dec. 5, 2006**

(54) NATIONAL SECURITY WARNING SYSTEM INTEGRATED WITH BUILDING FIRE ALARM NOTIFICATION SYSTEM

(75) Inventors: John R. Haynes, Groton, MA (US); Larry A. Zimmerman, Carlisle, MA (US)

(73) Assignee: SimplexGrinnell LP, Westminster, MA (US)

( * ) Notice: Subject to any disclaimer, the term of this patent is extended or adjusted under 35 U.S.C. 154(b) by 224 days.

This patent is subject to a terminal disclaimer.

(21) Appl. No.: 10/914,666

(22) Filed: Aug. 9, 2004

(65) Prior Publication Data

US 2006/0006996 A1 Jan. 12, 2006

Related U.S. Application Data

(63) Continuation-in-part of application No. 10/720,810, filed on Nov. 24, 2003.

(60) Provisional application No. 60/502,337, filed on Sep. 12, 2003.

(51) Int. Cl.
*G08B 17/00* (2006.01)
*G08B 17/10* (2006.01)
*G08B 17/12* (2006.01)

(52) U.S. Cl. ..... 340/628; 340/577; 340/286.05

(58) Field of Classification Search ..... 340/628, 340/632, 601, 602, 577, 539.26, 539.28, 340/286.02, 286.05, 291; 73/170.16, 170.34
See application file for complete search history.

(56) References Cited

U.S. PATENT DOCUMENTS

| | | | | |
|---|---|---|---|---|
| 4,417,217 | A | 11/1983 | Sugiyama | |
| 4,641,127 | A | 2/1987 | Hogan et al. | |
| 5,278,539 | A * | 1/1994 | Lauterbach et al. | 340/539.18 |
| 5,444,433 | A * | 8/1995 | Gropper | 340/601 |
| 5,949,332 | A | 9/1999 | Kim | |
| 6,121,885 | A * | 9/2000 | Masone et al. | 340/628 |
| 6,295,001 | B1 * | 9/2001 | Barber | 340/601 |
| 6,380,860 | B1 | 4/2002 | Goetz | |
| 6,426,697 | B1 * | 7/2002 | Capowski et al. | 340/506 |
| 6,462,665 | B1 * | 10/2002 | Tarlton et al. | 340/601 |
| 6,696,942 | B1 | 2/2004 | Sweatt | 340/539.1 |
| 6,710,715 | B1 | 3/2004 | Deeds | 340/601 |
| 2004/0085218 | A1 | 5/2004 | Pecora | |

FOREIGN PATENT DOCUMENTS

| | | |
|---|---|---|
| EP | 0 037 237 A2 | 10/1981 |
| EP | 0 269 747 B1 | 6/1988 |
| EP | 0 811 959 B1 | 12/1997 |
| EP | 0 834 846 B1 | 4/1998 |

OTHER PUBLICATIONS

Tony Pugh, "National warning systems in works," published in the Boston Globe on Feb. 25, 2002 in Boston, Massachusetts.
National Public Radio, South Dakota radio reporter, Curt Nickisch reporting on a system designed for emergency notification, Feb. 15, 2002.

* cited by examiner

*Primary Examiner*—Daniel Wu
*Assistant Examiner*—Jennifer Mehmood

(57) ABSTRACT

A fire alarm system includes a fire alarm notification appliance, and a warning detector which detects a warning alert from a military agency. The fire alarm notification appliance provides notification of the warning alert in response to detection of the warning alert.

40 Claims, 3 Drawing Sheets

NATIONAL SECURITY WARNING SYSTEM INTEGRATED WITH BUILDING FIRE ALARM NOTIFICATION SYSTEM

RELATED APPLICATION(S)

This application is a Continuation-in-Part of U.S. application Ser. No. 10/720,810 filed on Nov. 24, 2003, which claims the benefit of U.S. Provisional Application No. 60/502,337, filed Sep. 12, 2003. The entire teachings of the above application(s) are incorporated herein by reference.

BACKGROUND

Recently, U.S. Homeland Security Director Tom Ridge announced a soon-to-be-deployed national terrorism alert system whose goal is to provide a "unified warning apparatus that is universally understood. It has been proposed that the alarms would be broadcast over National Oceanic and Atmospheric Administration (NOAA) radios and would signal alert conditions—in descending order of urgency—of: critical, serious, alert and ready.

According to published information, the system would be used to alert state and local police and emergency personnel. According a report broadcast by National Public Radio on Feb. 15, 2002, the state of South Dakota has purchased 5,000 weather radios and is distributing them to universities, hospitals, law enforcement agencies and day care centers to provide a means of public emergency notification.

One advantage of the NOAA weather radios is that they turn themselves on when an alert is broadcast, increasing the likelihood that they will be noticed.

SUMMARY OF THE INVENTION

Because code-compliant fire alarm panels are already equipped with voice and/or audio and visual notification appliances, they provide a ready means with which to notify building occupants of a national alert.

In accordance with the present invention, a fire alarm system includes a fire alarm notification appliance, and a warning detector which detects a warning alert from an external source. The fire alarm notification appliance provides notification of the warning alert in response to detection of the warning alert or a change in the status of the warning alert.

The external source may be, but is not limited to, a government agency, such as the U.S. National Oceanic and Atmospheric Administration (NOAA) or a military agency. The warning detector may be a radio receiver equipped to receive the warning alert, such as a NOAA weather radio receiver, and may be, for example, integrated with a system controller or fire alarm control panel. Alternatively, the warning detector may comprise a component that interfaces to a NOAA weather radio receiver, for example, via relay contacts that open (or close) upon detection of a warning alert, or via a serial or some other data interface.

In alternate embodiments, the warning detector may receive warning alerts via means other than radio; for example, via the Internet, via telephone or via cellular phone. Other means of communication can also be used.

In one embodiment, a fire alarm notification appliance provides notification of the detected warning alert by transmitting a voice message. Alternatively, a notification appliance could provide notification by transmitting a predefined audio pattern, or by flashing a predefined strobe pattern.

Different notifications, such as different voiced messages, or different horn patterns, can be used for different warning alerts.

Delay and verification modules, which may comprise hardware or software or both, and which may be integrated with the system controller, can provide respectively a delay before transmission of the notification warning, and means for allowing confirmation of the validity of the warning alert before transmission of the notification, for example by authorized personnel.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

A description of preferred embodiments of the invention follows.

The present invention extends the concept of a national warning alert proposal by incorporating a NOAA weather radio receiver into, or interfacing a NOAA weather radio receiver with, a building fire alarm system. Because code-compliant fire alarm panels are already equipped with voice and/or audio and visual notification appliances, they provide a ready means with which to notify building occupants of a national alert. Code-compliant fire alarm panels are also equipped with battery backup power. In the event that normal AC power is lost, the panel can still transmit the notification.

For example, a national alert signal transmitted to a NOAA weather radio that is interfaced to a fire alarm system causes the fire panel, which has been pre-programmed to respond to the alert, to transmit a voice message to the occupants of the building. Such a message might be: "Attention! Attention! A security alert has been received from the National Homeland Security Department." Then, depending upon the level of the alert condition, the panel broadcasts an appropriate message. For example:

"A critical security alert has been received. Immediately implement response plan 1."

OR

"A ready security alert has been received. No action is required at this time. Stay tuned for further information."

In non-voice fire alarm systems, the notification horns and strobes could be programmed to signal building occupants using pre-defined patterns, e.g., temporal code. Training and drills will be needed to ensure that occupants will understand the various security alerts.

Such an alert system could be retrofit to most existing fire alarm systems with relatively little expense, enabling the government to notify a vast number of citizens quickly in a national emergency. The system could be put into place quickly and with a relatively small investment.

Implementation can be accomplished in several ways, including but not limited to the following:

1) The NOAA radio can be directly incorporated as a module within a fire panel; or 2) The NOAA radio can be interfaced to the fire panel via relay contacts; or 3) The NOAA radio can be interfaced to the fire panel through a serial interface device that translates the alert signal into a recognizable command to the fire alarm panel.

Figure 1:
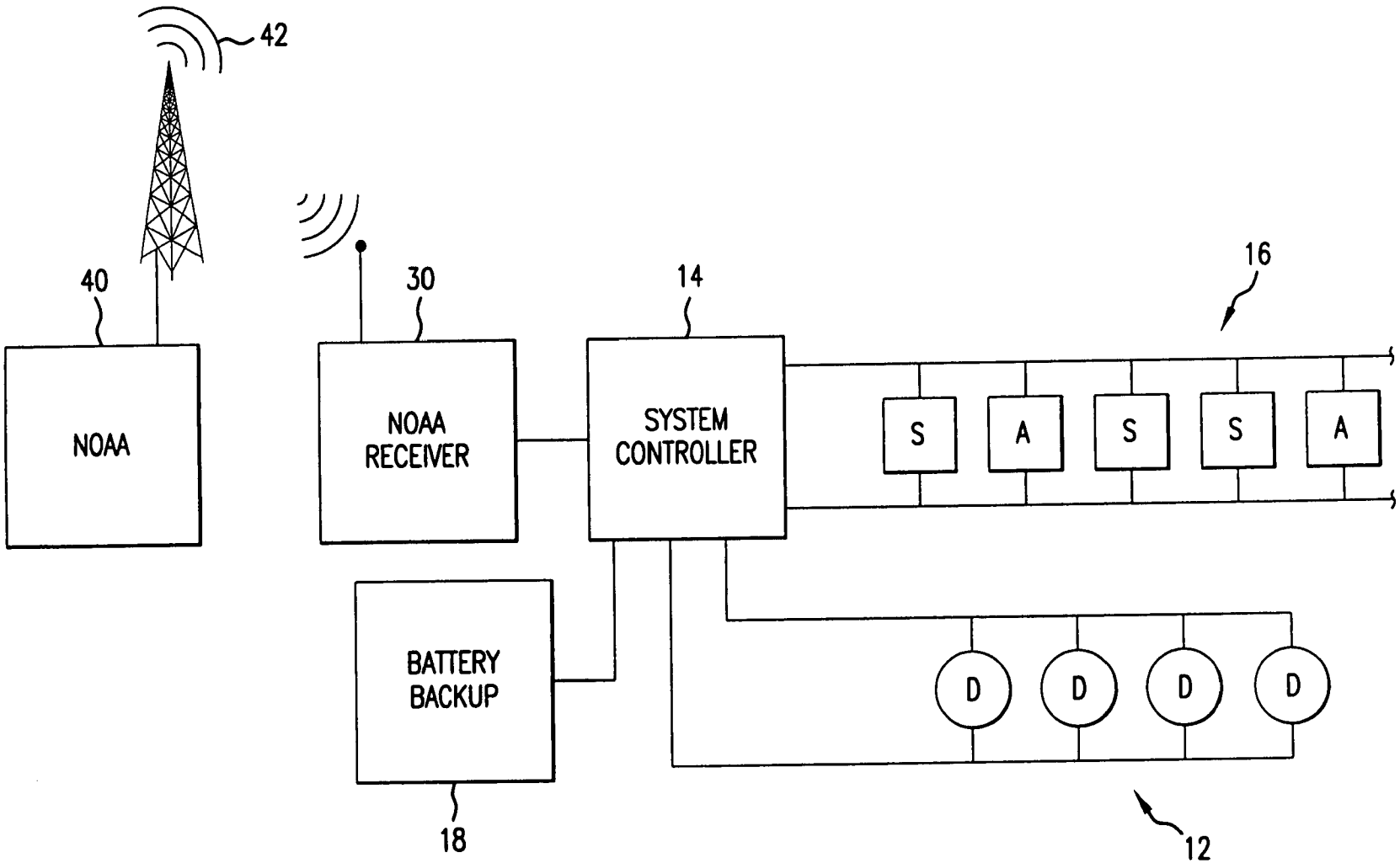
FIG. 1 is a schematic diagram illustrating an alarm system embodying the present invention.

FIG. 1 is a schematic diagram illustrating an alarm system embodying the present invention. The system may include one or more detector networks 12 having individual fire or smoke detectors D which are monitored by a system controller/fire alarm panel 14. When a fire or smoke alarm condition is sensed, the fire alarm panel 14 signals the alarm through at least one network 16 of alarm indicators, also called notification appliances. The notification appliances may include any variety of audible alarms A and light strobe alarms S.

An external NOAA receiver 30 is shown receiving a warning alert signal 42 broadcast from an NOAA transmitting station 40. A circuit performing the NOAA receiver function could also be incorporated directly into the system controller 14.

The system controller 14, which may be, for example, a fire alarm panel, is programmed to respond to the NOAA warning alert signal 42 with a series of pre-defined actions. For example, if an alert is received, a general announcement is played; if the alert level is "critical," then some particular message designated with that alert level is played.

Code-compliant fire alarm panels are typically equipped with a battery backup system 18. In the event that normal AC power is lost, the fire alarm panel 14 can still transmit a notification.

Embodiments of the present invention may include transmission of warning or emergency signals from one or more national, regional, state, provincial or local government agencies or departments, e.g., the old Emergency Broadcast System or the newer Emergency Alert System. In military settings, for example, such transmissions may include military communications. Media other than the NOAA weather radio can also transmit such signals. For example, an alert signal can be transmitted via the Internet, telephone, cellular phone, microwave link, satellite or other media to a fire panel equipped to receive such signals.

Figure 2:
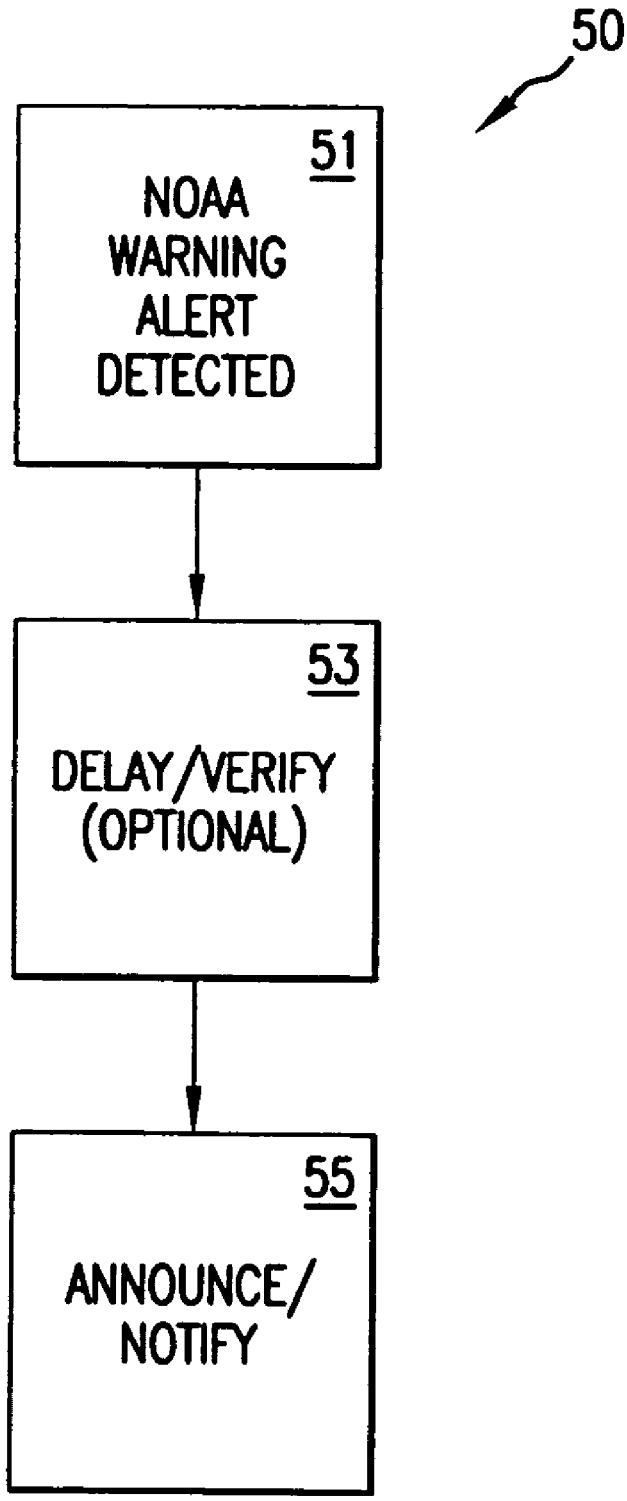
FIG. 2 is a flowchart illustrating the steps implemented by a particular embodiment of the present invention.

FIG. 2 is a flowchart 50 illustrating the steps implemented by a particular embodiment of the present invention. At step 51, a warning alert from an external source such as the U.S. NOAA, or some other government agency (although the invention is not limited only to government sources) is detected.

To prevent false alarms or panic situations, an embodiment of the present invention can, at step 53, incorporate a fixed or variable delay to the retransmission of the alert signal within the building for some pre-determined time period to give local building authorities time to confirm the validity of the received warning signal.

Finally, at step 55, the system announces, through voice or non-voice means, the warning alert.

Figure 3:
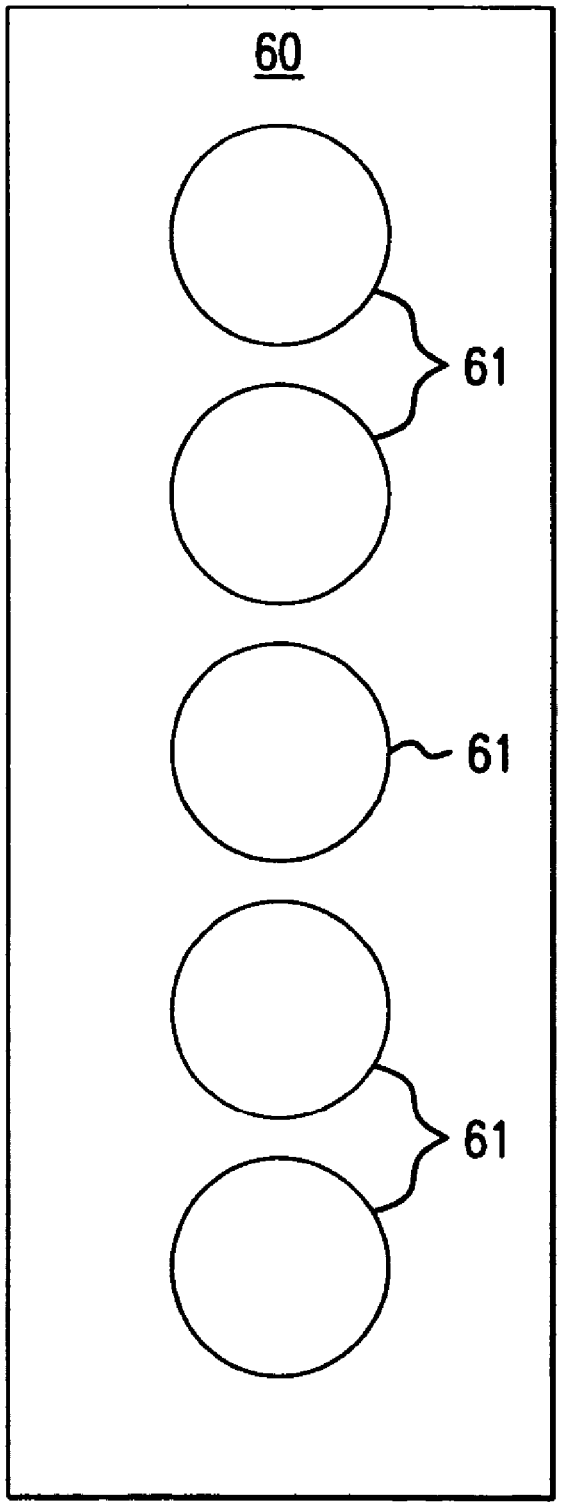
FIG. 3 is a schematic diagram of a visual annunciator of an embodiment of the present invention.

FIG. 3 is a schematic diagram of a visual annunciator 61 of an embodiment of the present invention which can give a continuous indication of the alert level. The visual annunciator has several visual indicators, e.g., lights or LEDs, which are preferably color-coded and correspond to the various emergency levels defined by the NOAA or other agency. The annunciator 61 may be integrated with or mounted on the fire control panel, or may stand as a separate unit apart from, but in communication with, the fire control panel. Five visual indicators are shown in FIG. 3 for illustrative purposes; however, one skilled in the art would recognize that a visual annunciator with a different number of visual indicators would fall within the scope of the present invention.

While this invention has been particularly shown and described with references to preferred embodiments thereof, it will be understood by those skilled in the art that various changes in form and details may be made therein without departing from the scope of the invention encompassed by the appended claims.

What is claimed is:

1. A fire alarm system, comprising:

a controller;

at least one hazard detector that detects any one of fire, heat, and smoke, and that communicates with the controller via a network;

at least one notification appliance in communication with the controller via the network;

a warning receiver, separate and distinct from any hazard detector, the warning receiver receiving a warning alert message from a source external to the fire alarm system, the external source being a military agency, the warning receiver providing at least a part of the received warning alert message to the controller, the controller, in response to the warning alert message, causing the at least one notification appliance to notify based at least in part on the received warning alert message.

2. The fire alarm system of claim 1, the notification appliance providing notification in response to detection of a change in alert status of the warning alert message.

3. The fire alarm system of claim 1, the warning receiver comprising a radio receiver equipped to receive the warning alert message.

4. The fire alarm system of claim 1, the warning receiver comprising an interface to a radio receiver equipped to receive the warning alert message.

5. The fire alarm system of claim 4, the interface comprising at least one relay contact.

6. The fire alarm system of claim 4, the interface comprising a serial interface.

7. The fire alarm system of claim 1, the warning receiver receiving warning alert messages via at least one of: Internet, telephone, and cellular phone.

8. The fire alarm system of claim 1, the notification appliance providing notification of the detected warning alert message by transmitting a voice message.

9. The fire alarm system of claim 1, the notification appliance providing notification of the detected warning alert message by transmitting a predefined audio pattern.

10. The fire alarm system of claim 1, the notification appliance providing notification of the detected warning alert message by transmitting a predefined flash pattern.

11. The fire alarm system of claim 1, the notification appliance providing different notifications for different warning messages.

12. The fire alarm system of claim 1, further comprising:

a delay module which provides a delay before transmission of the notification by the notification appliance.

13. The fire alarm system of claim 1, further comprising: a verification module which allows confirmation of validity of the warning alert message before transmission of the notification.

14. The fire alarm system of claim 1, further comprising: a battery backup system.

15. The fire alarm system of claim 1, further comprising: a visual annunciator comprising plural visual indicators used to indicate a current alert level.

16. The fire alarm system of claim 15, the visual indicators being light emitting diodes.

17. The fire alarm system of claim 15, the visual indicators being color-coded.

18. The fire alarm system of claim 15, the visual annunciator being incorporated into a fire alarm control panel.

19. The fire alarm system of claim 15, the visual annunciator being a stand-alone device in communication with the warning receiver.

20. The fire alarm system of claim 15, the visual annunciator being incorporated into the notification appliance.

21. In a fire alarm system comprising a controller, at least one hazard detector that detects any one of fire, heat, and smoke, and that communicates with the controller via a network, at least one notification appliance in communication with the controller via the network, and a warning receiver separate and distinct from any hazard detector, a method, in the fire alarm system, for providing warnings, the method comprising:

receiving, by the warning receiver, a warning alert from an external source, the external source being a military agency;

providing, by the warning receiver, at least a part of the received warning alert message to the controller; and the controller in response to the warning alert message, causing the at least one notification appliance to notify based at least in part on received warning alert message.

22. The method of claim 21, further comprising: providing, from the notification appliance, notification in response to detection of a change in alert status of the warning alert message.

23. The method of claim 21, the warning alert message being detected by a radio receiver equipped to receive the warning alert message, the radio receiver being integrated into the fire alarm system.

24. The method of claim 21, the warning alert message being detected by a radio receiver equipped to receive the warning alert, the radio receiver interfaced with the fire alarm system.

25. The method of claim 24, the method further comprising: signaling detection of the warning alert message by actuating at least one relay contact.

26. The method of claim 24, the method further comprising: signaling detection of the warning alert message via a serial interface.

27. The method of claim 21, warning alert messages being received via at least one of: Internet, telephone, and cellular phone.

28. The method of claim 21, causing the at least one notification appliance to notify of the detected warning alert message comprising:

transmitting a voice message.

29. The method of claim 21, causing the at least one notification appliance to notify of the detected warning alert message comprising: transmitting a predefined audio pattern.

30. The method of claim 21, causing the at least one notification appliance to notify of the detected warning alert message comprising:

transmitting a predefined flash pattern.

31. The method of claim 21, further comprising: providing different notifications for different warning alert messages.

32. The method of claim 21, further comprising: delaying transmission of the notification.

33. The method of claim 21, further comprising: providing means for confirmation of validity of the warning alert message before transmission of the notification.

34. The method of claim 21, further comprising: indicating, in a visual annunciator with plural visual indicators, a current alert level.

35. The method of claim 34, the visual indicators being color-coded.

36. The method of claim 34, the visual annunciator being incorporated into a fire alarm control panel.

37. The method of claim 34, the visual annunciator being a stand-alone device in communication with the warning receiver.

38. The method of claim 34, the visual annunciator being incorporated into the notification appliance.

39. A fire alarm system comprising:

means for controlling at least a part of the fire alarm system;

means for detecting at least one of fire, heat, and smoke in communication with the means for controlling;

means for receiving a warning alert from an external source and for providing at least a part of the received warning alert to the means for controlling, the external source being a military agency, the means for receiving a warning alert being separate and distinct from any means for detecting; and means for providing, from a fire alarm notification appliance, notification of the warning alert based at least in part on the received warning alert in response to a message from the means for controlling.

40. A fire alarm system, comprising:

a system controller;

a plurality of fire detectors in communication with the system controller, the detectors detecting any one of fire, heat, and smoke;

a warning receiver in communication with the system controller, the warning receiver, separate and distinct from any fire detector, the warning receiver receiving a warning alert from a source external to the fire alarm system, the external source being a military agency, the warning receiver providing at least a part of the received warning alert to the system controller; and a visual annunciator comprising plural color-coded indicators, the visual annunciator being in communication with the system controller and indicating a current alert level in response to a message from the system controller.

* * * * *

UNITED STATES PATENT AND TRADEMARK OFFICE

CERTIFICATE OF CORRECTION

PATENT NO. : 7,145,466 B2
APPLICATION NO. : 10/914666
DATED : December 5, 2006
INVENTOR(S) : John R. Haynes et al.

It is certified that error appears in the above-identified patent and that said Letters Patent is hereby corrected as shown below:

In column 5, claim 21, line 36, after "at least in part on" insert --the--.

Signed and Sealed this

Fourteenth Day of September, 2010

David J. Kappos

David J. Kappos
*Director of the United States Patent and Trademark Office*